United States Patent [19]

Förster

[11] Patent Number: 4,597,336

[45] Date of Patent: Jul. 1, 1986

[54] ACTIVE SWITCH

[75] Inventor: Hans-Joachim Förster, Stuttgart, Fed. Rep. of Germany

[73] Assignee: Daimler-Benz AG, Fed. Rep. of Germany

[21] Appl. No.: 558,008

[22] Filed: Dec. 5, 1983

[30] Foreign Application Priority Data

Dec. 4, 1982 [DE] Fed. Rep. of Germany ..... 3244974

[51] Int. Cl.[4] ..... E01B 26/00

[52] U.S. Cl. ..... 104/130; 104/247

[58] Field of Search ..... 104/130, 247, 96, 103; 246/273, 276, 434

[56] References Cited

U.S. PATENT DOCUMENTS

| | | | |
|---|---|---|---|
| 2,121,696 | 6/1938 | Horn | 104/130 |
| 2,997,004 | 8/1961 | Rosenbaum | 104/130 |
| 3,095,827 | 7/1963 | Chadenson | 104/247 |
| 4,389,942 | 6/1983 | Düll | 104/130 |

FOREIGN PATENT DOCUMENTS

| | | | |
|---|---|---|---|
| 2723733 | 11/1978 | Fed. Rep. of Germany | 104/130 |
| 3004406 | 8/1981 | Fed. Rep. of Germany | 104/130 |
| 0619629 | 4/1961 | Italy | 104/130 |
| 1531425 | 11/1978 | United Kingdom | 104/130 |

*Primary Examiner*—Robert B. Reeves
*Assistant Examiner*—Dennis C. Rodgers
*Attorney, Agent, or Firm*—Craig and Burns

[57] ABSTRACT

An active switch for the intersection region of tracks for mechanically transversely or laterally guided vehicles having support wheels without flanges; the switch which is adapted to be forced open by the vehicle and includes only a single adjustable switch member in the form of a switch tongue pivotal about a fixed bearing in the switch frog, is bent into its end position by the vehicle itself by being pressed against abutments; the cross section of the switch tongue has an approximately constant bending stiffness over its length whereby the switch tongue in the unstressed condition preferably has a curvature that lies between the curvatures of the one and the other end position.

15 Claims, 3 Drawing Figures

ACTIVE SWITCH

The present invention relates to an active switch for the intersection area of tracks for mechanically transversely-guided vehicles of the type disclosed in the German Offenlegungsschrift No. 27 23 733.

Mechanically transversely-guided vehicles require special tracks with approximately horizontal wheel running surfaces for support wheels without flanges and with vertical lateral guide webs or strips which, arranged to protrude on both sides, delimit the track.

Substantially inflexible transverse guide arrangements with transverse or lateral guide rollers having a vertical axis run along the lateral guide webs or strips on both sides under slight pressure.

Within the intersection area of the tracks of a bifurcation, switches are required which permit a vehicle to enter a common track or to branch from a common track into one of two possible branching tracks. One of the tracks may thereby be straight and the other may be curved, or both may also be curved.

In prior art active switch systems, the guide elements for switching the guide direction are arranged in the track.

For the purpose of switching, movable lateral guide webs or strips (switch tongues) are used which are adjustable, for example, by means of actuating drives, such as hydraulic actuating cylinders, whereby fixed in their respective end position, the lateral guide webs or strips make it possible together with outer fixed lateral guide webs or strips for one of the two tracks to be selectively travelled over by a vehicle while being mechanically laterally guided.

A switch is disclosed in the German Offenlegungsschrift No. 27 23 733 with a switch tongue which is pivotally supported about a vertical axis in the switch frog and which is so shaped in its lateral flanks that in each of its pivoted end positions, it forms the track together with the respectively oppositely disposed lateral guide webs or strips. The switch tongue must be relatively stiff in bending by reason of its prescribed shape. It becomes thicker at its ends, whence apertures must be provided in the lateral cross-guide webs or strips within the area of its free end which are replaced by additional movable tongues, and which displace the main switch tongue in each of its end positions toward the side transversely out of the track. Consequently, this prior art construction involves a system of three switch tongues which are coupled with each other.

The German Offenlegungsschrift No. 30 04 406 describes a switch construction whose two switch tongues are fixedly clamped-in within the area of the transistion to the common track and whose switch tongues possess such a variation of surface inertia moment in bending about the vertical axis that with a horizontal deflection by the actuating cylinders, it will adjust itself within the area of the free end of the switch tongues as a free bending line to the desired shape of the respective track. In their end positions, the switch tongues are each transversely supported.

The prior art switches are very complicated in their construction. Accurately fitting contours have to be manufactured and installed.

High switch-actuating forces required by switch tongues which have to be elastically deformed, make large demands on the switching mechanism. For this reason, the prior art switches are relatively susceptible to failures and malfunctioning.

The present invention is concerned with the task to provide a constructively simple switch which is adapted to be forced open, i.e., in which the switch tongue is pivoted into proper position by the vehicle itself as it enters the switch by means of its transverse guide rollers.

The underlying problems are solved according to the present invention in that the transverse guide webs or strips which delimit the intersection area of the tracks on the outside thereof, are immovable throughout without interruption and the switch tongue is the sole adjustable switch member, whereby the switch tongue is elastically deformable by transverse guide devices of the vehicle and has an approximately constant bending strength or stiffness over its length, and in that fixed abutments are arranged within the intersection area between the wheel running surfaces, which predetermine the contour of the switch tongue pressed thereagainst in its respective end position.

The switch tongue is so constructed and shaped in its unstressed condition that in the pivoted condition, the tip abuts at the respective transverse guide web or strip so that a continuous transition from transverse guide web to switch tongue makes travel possible through the switch, especially also in the direction toward the branching-off track. A curvature of the switch tongue is preferred for this purpose which, in the unstressed condition, lies between the curvatures which it assumes in the one and the other end position.

In order to prevent that the switch tongue is twisted during the pivoting operation, corresponding guide devices may be provided.

An automatically engaging locking mechanism prevents the spring-back or springy return of the switch tongue after a vehicle passes rapidly therethrough. The internal stress of the switch tongue in its end position can be used, possibly with the assist of return springs during unlocking by a vehicle-actuated switch, for pivoting the switch tongue in case of a travel to the common track. Smaller opening forces and practical velocities can be attained thereby.

The advantages attained with the present invention consist in particular in assuring a reliable functioning as well as cost-favorable manufacture and installation of the switch by constructively simple structural parts with only a single movable switch tongue.

Additionally, the switch tongue can be forced open during slow travel of the vehicle due to the small weight of the switch tongue and can be forced open at higher velocities by means of appropriate additional devices.

These and other objects, features and advantages of the present invention will become more apparent from the following description when taken in connection with the accompanying drawing which shows, for purposes of illustration only, one embodiment in accordance with the present invention, and wherein.

Figure 1:
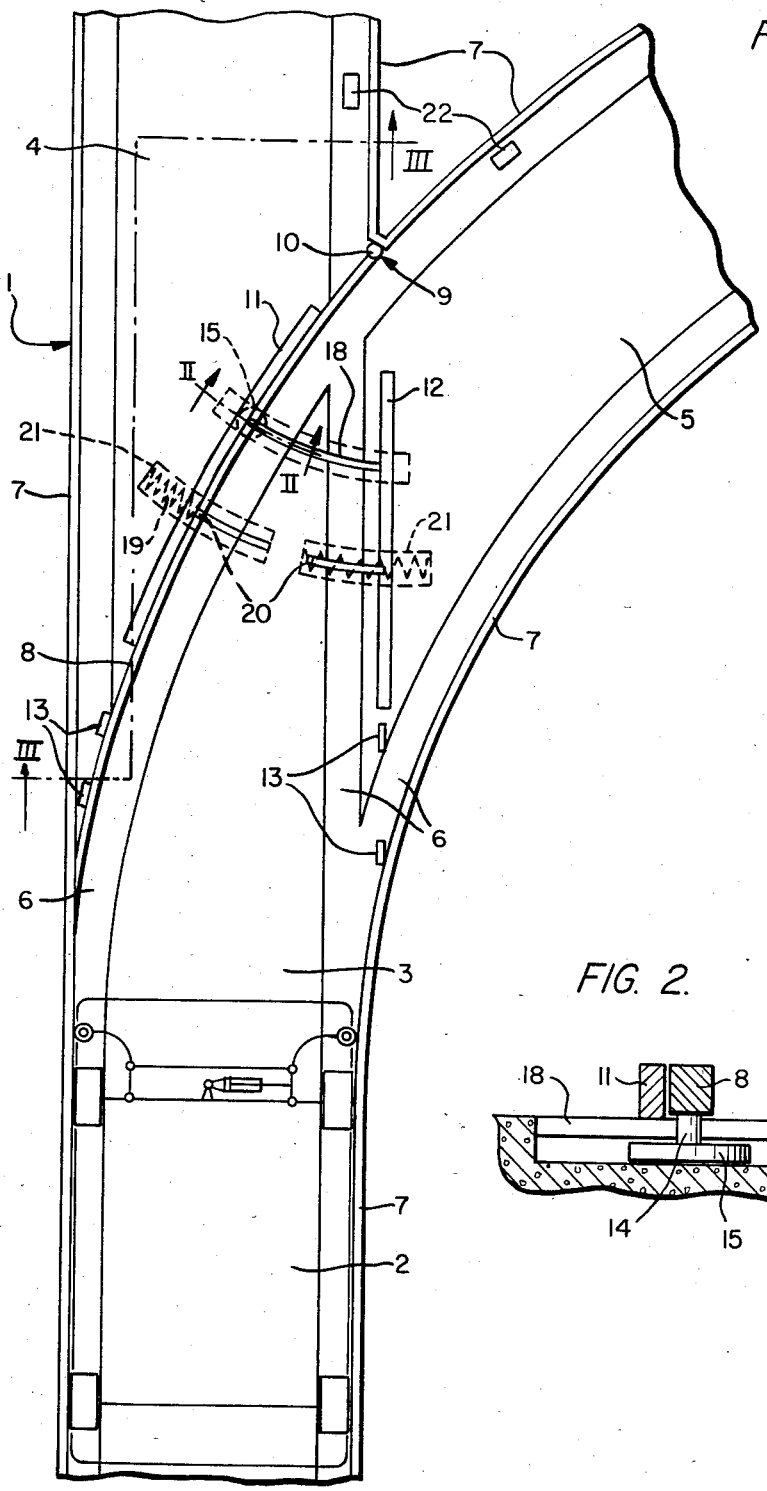
FIG. 1 is a plan view on an active switch in accordance with the present invention with a mechanically transversely guided vehicle located thereon.

Referring now to the drawing wherein like reference numerals are used throughout the two views to designate like parts, FIG. 1 illustrates a plan view on a switch generally designated by reference numeral 1 for a mechanically track-guided vehicle 2.

A common track 3 branches into a track 4 continuing in a straight line and a track 5 curving away from the common track 3. The tracks are constructed of horizontal wheel-running surfaces 6 and of vertical transverse guide webs or strips 7 arranged along the sides thereof.

The outer transverse or lateral guide webs or strips 7 extend without interruption within the area of the switch. The transverse guide webs or strips 7 are constructed as switchable switch tongue 8 within the area of intersection of the tracks; the switch tongue 8 is pivotal in a bearing 10 at the point of intersection 9 of the branching-off transverse guide webs or strips.

The switch tongue 8 has preferably an average curvature that lies between the curvatures of its one and other end position.

The tip of the switch tongue 8 contacts an outer transverse guide web 7.

Two abutments 11 and 12 for the switch tongue 8 are arranged within the area of intersection; however, the two abutments 11 and 12 are located outside of the wheel running surfaces 6 and thus do not interfere with the passage of the wheels.

Figure 3:
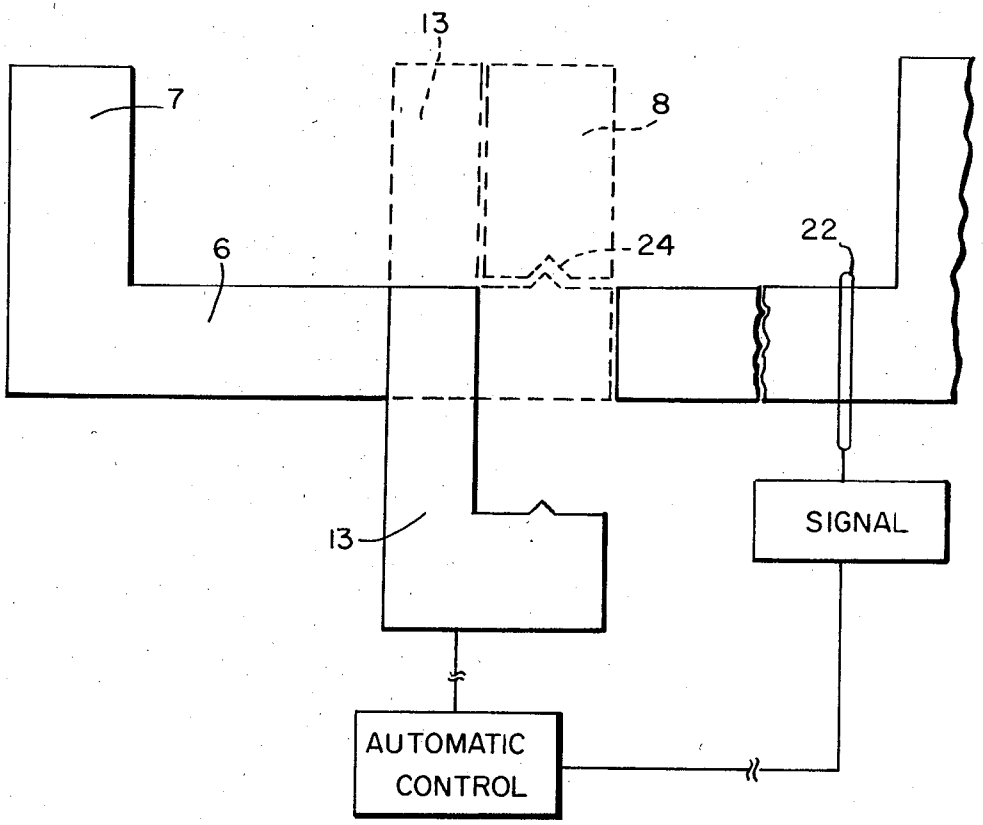
FIG. 3 is a cross-sectional view through the switch, taken along line III—III of FIG. 1 showing the latch mechanism with its electric actuator in retracted position in full lines and engagement position in dotted lines.

Additional abutments 13 (FIG. 3) for the switch tongue 8 which may eventually become necessary, may also be constructed as locking mechanisms of any known type. Since the switch tongue 8 must be smooth on both of its side surfaces, the locking mechanisms can only engage from below into corresponding apertures or recesses 24 provided in the bottom of the tongue 8.

Return springs 19 with pins or rods 20 projecting out of the track are accommodated in guide conduits or channels 21 located under the track.

Figure 2:
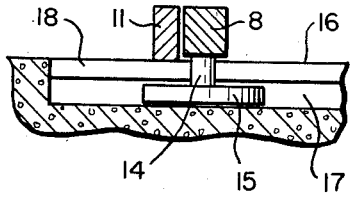
FIG. 2 is a cross-sectional view through the switch taken along line II—II of FIG. 1.

FIG. 2 illustrates a cross section along the dash and dotted line of FIG. 1. The switch tongue 8 rests at the abutment 11 and is connected by way of a spacer member 14 cross plate or rod 15 which extends in an underground guide track or channel 17 underneath the track 16.

A vehicle 2 entering the switch area, which either comes from the common track 3 and depending on the position of the switch tongue 8 enters one of the branching-tracks 4 or 5, or which enters from one of the branching-tracks 4 or 5 into the common track 3, is guided by means of its transverse guide installation by way of transverse guide rollers which detect transverse or lateral guide webs 7 that extend uninterruptedly on both sides.

The switch tongue 8 and the fixed outer transverse guide webs 7 form within area of intersection the vertical edges belonging to the respective track.

The switch tongue 8 can be pivoted by external means by way of actuating cylinders or can also be forced open by the vehicle 2 itself, though only with a slow travel in the direction toward the common track 3. The term "forcing open" means that the vehicle 2 itself pivots the switch tongue 8 by of its transverse guide rollers during entry into the switch.

The transverse installation must absorb the forces from the inertia of the switch tongue 8 which result during the pivot operation, which imposes a limit to the maximum travel velocity when forcing the switch open.

The switch 1 can be travelled through in the direction toward the branching-tracks 4 and 5 only if the switch tongue 8 is so shaped in the unstressed condition that when pivoted into the respective end position, it initially contacts the respective continuous tranverse guide web 7 with its tip. With a curvature that in the unstressed condition preferably lies between the curvatures that the switch tongue assumes in its one and other end position, it is assured that the tip of the tongue abuts at the respective transverse guide web.

In the pivoted position the tongue 8 together with the respective oppositely disposed transverse guide web 7 forms a throat for the transverse guide installation of the vehicle 2, which is removed in that the transverse guide installation of the vehicle bends open the switch tongue 8 by way of the transverse guide rollers to correspond to the shape and contour of the respective outer transverse guide web 7.

Depending on the travel direction, the switch tongue 8 is thereby pressed into the abutment 11 or 12, which have such a contour that, on the one hand, they support the switch tongue 8 in the transverse direction and, on the other, permit a deformation of the tongue 8 that corresponds in each case to the contour of the oppositely disposed transverse guide web 7.

The tongue 8 must be longitudinally displaceable during the bending operation. For this reason, no impairments or interferences to sliding movements in the longitudinal direction must be present especially within the area of the tip of the tongue 8.

In order to prevent that the relatively slender switch tongue 8 is twisted under load, for example, during the pivot operation when being forced open or bent open, the switch tongue 8 may be connected at one or several places with a guide plate or guide rod 15 (FIG. 2) guided exclusively horizontally in a guide channel 17 located below the track surface 16, whereby the connection is rigid against torsion of the switch tongue 8.

The connection by way of the spacer member 14 between switch tongue 8 and the guide plate or rod 15 may thereby permit longitudinal displacements of the tongue 8, or the guide channel 17 may be correspondingly constructed for longitudinal displacements.

The guide channels 17 which are covered, for example, by means of a plate having guide slots, do not hinder the wheel movement since the openings are relatively narrow on the side of the track.

The underground guide plate or rod 15 may additionally be constructed as abutment or may lock the switch tongue 8 in its end position by additional means of any known type. For that purpose, also separate devices may be provided.

A locking of the switch tongue 8 in its end position may be necessary in order to avoid a spring-back or springy return movement of the switch tongue 8 into the track area 3 after a vehicle passes through rapidly. In particular, if a vehicle possesses transverse guide rollers only within the area of its front axle and the other axle merely trails behind, the switch tongue 8, when sprung-back or in the unstressed condition, may cover the wheel running surfaces 6 of the trailing wheels.

In order to attain practical velocities when forcing open the switch, the force to be applied by the vehicle for overcoming the inertia of the switch tongue 8 must be kept as small as possible. This can be realized in that the spring force of the elastically deformable switch tongue 8 is used, possibly with the assistance of prestressed return springs 19 which act on the switch tongue 8 in the transverse direction and seek to pivot the switch tongue 8 in the direction toward the respective abutment.

The return springs 19 which are guided underground on both sides of the switch tongue 8 and which are possibly also accommodated in guide channels 17, engage at the switch tongue 8 with the pins or rods 20 projecting into the track. During the pivoting, one of the return springs 19 will be relieved whereas the other return spring is stressed when the switch is forced open.

In addition, conventional switches 22 (FIGS. 1 and 3) which can be operated from the vehicle and which are connected with the end position locking mechanism and with the return springs 19, must be present; these switches 22 are arranged in the tracks 4 and 5 entering the common track 3 ahead of the switch and are effective only if a vehicle travels in the direction toward the common track 3, and then only if the switch 1 is to be forced open. Actuating cylinders which are connected with the switch tongue 8, must thereby be fluidically released.

During the switching of the switch tongue 8 by means of actuating cylinders, the return springs may remain fixed in their stressed position and do not exert any forces on the switch tongue 8.

The support of the weight of the switch tongue 8 takes place in the form of support rollers or skids which run in corresponding guide tracks laid in the ground.

The actuation of the switch tongue 8 from the outside takes place, for example, by means of hydraulic cylinders connected with locking mechanisms and supports, possibly retractable into the ground.

The switch tongue 8 terminates symmetrically and narrowly at its free end so that the tip of the tongue contacts the flanks of the transverse guide webs 7 in such a manner that the transition is as shock-free as possible.

While I have shown and described only one embodiment in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. An active switch for the interaction area of tracks with horizontal wheel running surfaces and with substantially vertical transverse guide web means, arranged to project on both sides, for mechanically transversely guided vehicles, comprising an intersection area of a track bifurcation coming from a common track or a track junction entering a commom track, the transverse guide web means which delimit the intersection area of the tracks on the outside being immovable and running throughout the intersection area without interruption, further comprising a single switch tongue means being the only adjustable vehicle guiding switch member and being pivotable about a fixed bearing at the branch point of the intersection and a free end of the switch tongue means pointing in the direction toward the common track, and said switch tongue means being elastically bendable by lateral guide devices of a vehicle and having an approximately constant bending stiffness along its length, and fixed abutment means within the area of intersection between the wheel running surfaces, said abutment means determining the contour of the switch tongue means when pressed thereagainst in its respective end position, wherein, within the intersection area of the track extending from the branch point to a point where the free end of the tongue means comes in contact with the transverse guide web means of the common track, the full vertical extent of guide elements on both sides of the vehicle come in contact with either the transverse guide web means or the switch tongue means respectively.

2. A switch according to claim 1, wherein the switch tongue means is so shaped in the unstressed condition that during pivoting into the respective end position it first contacts the associated uninterrupted transverse guide web means with its tip.

3. A switch according to claim 2, wherein the curvature of the switch tongue means in the unstressed condition lies between the curvatures which it assumes in its one and other end position.

4. A switch according to claim 3, further comprising guide means guided exclusively horizontally in underground guide channel means, and connecting means connecting the switch tongue means at least in one place thereof with said guide means for common pivotal movement, the connecting means being substantially rigid against torsion of the switch tongue means.

5. A switch according to claim 4, further comprising an automatically engaging end-position locking means for the switch tongue means.

6. A switch according to claim 5, further comprising vehicle-actuated switch means operable to disengage the end-position locking means, said switch means being located ahead of the switch in the guide tracks terminating in the common track and being operable only if a vehicle travels in the direction toward the common track and only if the switch is to be forced open by the vehicle.

7. A switch according to claim 6, wherein at least one return spring means each is provided on each side of the switch tongue means, said return spring means being guided underground and engaging at the half belonging to the tongue tip.

8. A switch according to claim 1, wherein the curvature of the switch tongue means in the unstressed condition lies between the curvatures which it assumes in its one and other end position.

9. A switch according to claim 1, further comprising guide means guided exclusively horizontally in underground guide channel means, and connecting means connecting the switch tongue means at least in one place thereof with said guide means for common pivotal movement, the connecting means being substantially rigid against torsion of the switch tongue means.

10. A switch according to claim 9, wherein the curvature of the switch tongue means in the unstressed condition lies between the curvatures which it assumes in its one and other end position.

11. A switch according to claim 1, further comprising an automatically engaging end-position locking means for the switch tongue means.

12. A switch according to claim 11, further comprising vehicle-actuated switch means operable to disengage the end-position locking means, said switch means being located ahead of the switch in the guide tracks terminating in the common track and being operable only if a vehicle travels in the direction toward the common track and only if the switch is to be forced open by the vehicle.

13. A switch according to claim 12, wherein at least one return spring means each is provided on each side of the switch tongue means, said return spring means being guided underground and engaging at the half belonging to the tongue tip.

14. A switch according to claim 13, further comprising guide means guided exclusively horizontally in underground guide channel means, and connecting means connecting the switch tongue means in at least one place thereof with said guide means for common pivotal movement, the connecting means being substantially rigid against torsion of the switch tongue means.

15. A switch according to claim 11, wherein at least one return spring means each is provided on each side of the switch tongue means, said return spring means being guided underground and engaging at the half belonging to the tongue tip.

* * * * *